US006007178A

United States Patent [19]

Asano

[11] Patent Number: 6,007,178

[45] Date of Patent: Dec. 28, 1999

[54] DRIVE GEAR SYSTEM USING A SINGLE MOTOR FOR A PRIMING OPERATION AND DRIVING A PLATEN IN A POSTAGE METER

[75] Inventor: Kazuya Asano, Nagoya, Japan

[73] Assignee: Pitney Bowes Inc., Stamford, Conn.

[21] Appl. No.: 08/702,078

[22] Filed: Aug. 23, 1996

[51] Int. Cl.[6] ..... B41J 2/165

[52] U.S. Cl. ..... 347/30

[58] Field of Search ..... 342/30, 31, 32, 342/33; 400/701, 702.1, 702; 347/30, 31, 32, 33, 104; 74/384, 354, 665 F, 665 GA; 475/12

[56] References Cited

U.S. PATENT DOCUMENTS

| | | | |
|---|---|---|---|
| 4,184,780 | 1/1980 | Kurihara et al. | 400/56 |
| 4,227,819 | 10/1980 | Manriquez | 400/56 |
| 4,389,657 | 6/1983 | McMahon | 347/68 |
| 4,441,420 | 4/1984 | Buan et al. | 101/69 |
| 4,489,651 | 12/1984 | Deluca et al. | 271/269 |
| 4,523,523 | 6/1985 | Abellana et al. | 101/235 |
| 4,579,054 | 4/1986 | Buan et al. | 101/91 |
| 4,658,274 | 4/1987 | DeYoung | 347/88 |
| 4,872,521 | 10/1989 | Abellana et al. | 177/25.15 |
| 5,118,208 | 6/1992 | Kitahara et al. | 400/56 |
| 5,138,343 | 8/1992 | Aichi et al. | 347/33 |
| 5,156,467 | 10/1992 | Kitahara et al. | 400/58 |
| 5,216,442 | 6/1993 | Parks et al. | 347/42 |
| 5,325,111 | 6/1994 | Dietl | 347/30 |

FOREIGN PATENT DOCUMENTS

| | | | |
|---|---|---|---|
| 0405356B1 | 11/1994 | European Pat. Off. | G07B 17/00 |
| 0701061A1 | 3/1995 | European Pat. Off. | F04B 7/04 |

*Primary Examiner*—N. Le
*Assistant Examiner*—Thien Tran
*Attorney, Agent, or Firm*—Steven J. Shapiro; Melvin J. Scolnick

[57] ABSTRACT

A postage meter includes a printing device for printing a dot-matrix postal indicia on a mailpiece; and a drive train system having a moveable platen for positioning the mailpiece in fixed relationship to the printing device; a priming pump operatively connectable to the printing device for priming the printing device; a gear train; and a motor engaged with the gear train for driving into operation, via the gear train, both the platen and the priming pump. A method for driving components of a postage meter, includes energizing a motor in a first direction for driving, via a gear train, a platen into a fixed position relative to a printhead used for printing a postage indicia; driving, via the gear train, a priming pump into operation for priming the printhead; and during driving of the priming pump utilizing the gear train for effectuating moving of a wiper blade into a position for wiping the printhead.

11 Claims, 5 Drawing Sheets

DRIVE GEAR SYSTEM USING A SINGLE MOTOR FOR A PRIMING OPERATION AND DRIVING A PLATEN IN A POSTAGE METER

BACKGROUND

This invention relates to a postage meter and more particularly to a drive system in a postage meter for driving a platen, a priming pump, and a wiping mechanism.

Postage meters which imprint an indicia on a mailpiece or a label to be subsequently placed on a mailpiece have been used for approximately the last 75 years. The indicia is used in lieu of stamps and serves as evidence that postage has been paid. Moreover, since the indicia is compatible with postal service processing equipment, its handling can be expedited as compared to stamps. Thus, the postal service offers discounts to mailers using postage meters that print the indicia and additional identifying data which can be read by postal automated equipment. Typically, however, traditional postage meters, whether functioning as a stand-alone unit or as part of a mailing machine, were utilized by medium-sized and large-sized businesses having a fairly large and continuous stream of outgoing mail. Due to the costs of manufacturing these traditional postage meters the price to the consumer, as either a rented unit or a procured unit, would often preclude very small businesses from obtaining such a postage meter. That is, these small businesses couldn't justify the cost as compared to simply applying stamps to their mailpieces. However, throughout the world and particularly in the United States, a growing number of small office and home office (SOHO) businesses are being formed. It is anticipated that this segment of the business market will be the fastest growing segment in the years to come. While the SOHO businesses still are concerned about the expense associated with obtaining a postage meter, they often want to create the impression that their business is just as professional as the medium and large-sized businesses. One way of doing this is by sending mailpieces having a printed indicia or a printed indicia together with the company's personalized advertising slogan in lieu of applying postage stamps to their mailpieces. Accordingly, what is needed for the SOHO business market is a low cost postage meter product.

With the advancement of digital printing technology, such as inkjet printers, the cost associated with producing a printing apparatus have been reduced. Moreover, with the advancements in electronics and the miniaturization of electronic components, the efficiency, cost, and footprint of postage meters can all be reduced. However, the postage meter still relies on a number of mechanical components in order to ensure that continued repetitive good quality printing can be accomplished by, for example, an inkjet printing device. That is, with an inkjet printing apparatus the distance between the recording medium being printed on and the printhead nozzles must be precisely controlled in order to ensure a good print quality. Moreover, inkjet printers are subject to certain problems that did not exist with the previous printing technologies used in meters. The small ink ejection nozzles which are used in inkjet printers to expel drops of ink in a dot-matrix pattern on the recording medium are subject to becoming 1) clogged by dirt or paper dust, 2) deprimed to due the entrapment of air within the nozzle or the ink supply line leading from the nozzle to the ink supply, and 3) clogged if they are not used over an extended period of time such that the ink resident in the nozzles dries up.

To control the precise gap between the nozzles and the mailpiece, a movable platen can be used to properly position the mailpiece for printing thereon. Additionally, as is known in the art, a priming pump can be connected to a printhead maintenance station for drawing a vacuum on the nozzles when they are in a non-printing position in order to draw ink through the nozzles to remove contaminants, dried ink, or air which may be contained therein. Furthermore, a wiper blade can be used to wipe across the nozzles to remove excess ink and contamination from around the nozzle openings or the orifice plate within which the nozzles have been formed.

In previous inkjet printing devices, such as typewriters, it has been known to use a separate motor to drive the priming pump and a separate motor to properly position a wiper for wiping the nozzles. Moreover, in postage meters it is known to use a dedicated motor for the purpose of raising and lowering a platen. However, if three such motors were used in a low cost postage meter they would add to the footprint of the meter and drive up the cost of the postage meter. Accordingly, what is needed is a drive system in a postage meter which can be used to accomplish a plurality of the functions discussed above while minimizing the number of motors required. Ideally, this inventive drive train system should be capable of raising the platen, driving the priming pump, and positioning the wiper blade.

SUMMARY OF THE INVENTION

The instant invention is directed toward a method and apparatus for driving a plurality of functional components in a postage meter. The drive system uniquely accomplishes the plurality of functions while reducing: 1) the number of components required, 2) the overall footprint of the postage meter, and 3) the manufacturing cost of the postage meter. In one embodiment, the postage meter which has a printing device for printing a dot-matrix postal indicia on a mailpiece includes a drive train system comprising a moveable platen for positioning the mailpiece in fixed relationship to the printing device; a priming pump operatively connectable to the printing device for priming the printing device; a gear train; and a motor engaged with the gear train for driving into operation, via the gear train, both the platen and priming pump.

In yet another embodiment, the postage meter includes a drive train system as discussed above, and further includes a wiper blade moveable between an operative position for wiping the printing device and an inoperative position where no wiping occurs. The motor drives the gear train into operative engagement with the wiper blade for effectuating movement of the wiper blade between the inoperative and operative positions.

A method for driving components of a postage meter that is associated with the inventive apparatus includes energizing a motor in a first direction for driving via a gear train a platen into a fixed position relative to a printhead for printing a postage indicia; energizing the motor in a second direction for driving via the gear train a priming pump into operation for priming the printhead; and during driving of the priming pump utilizing the gear train for effectuating moving of a wiper blade into a position for wiping the printhead.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENTS

Figure 1:
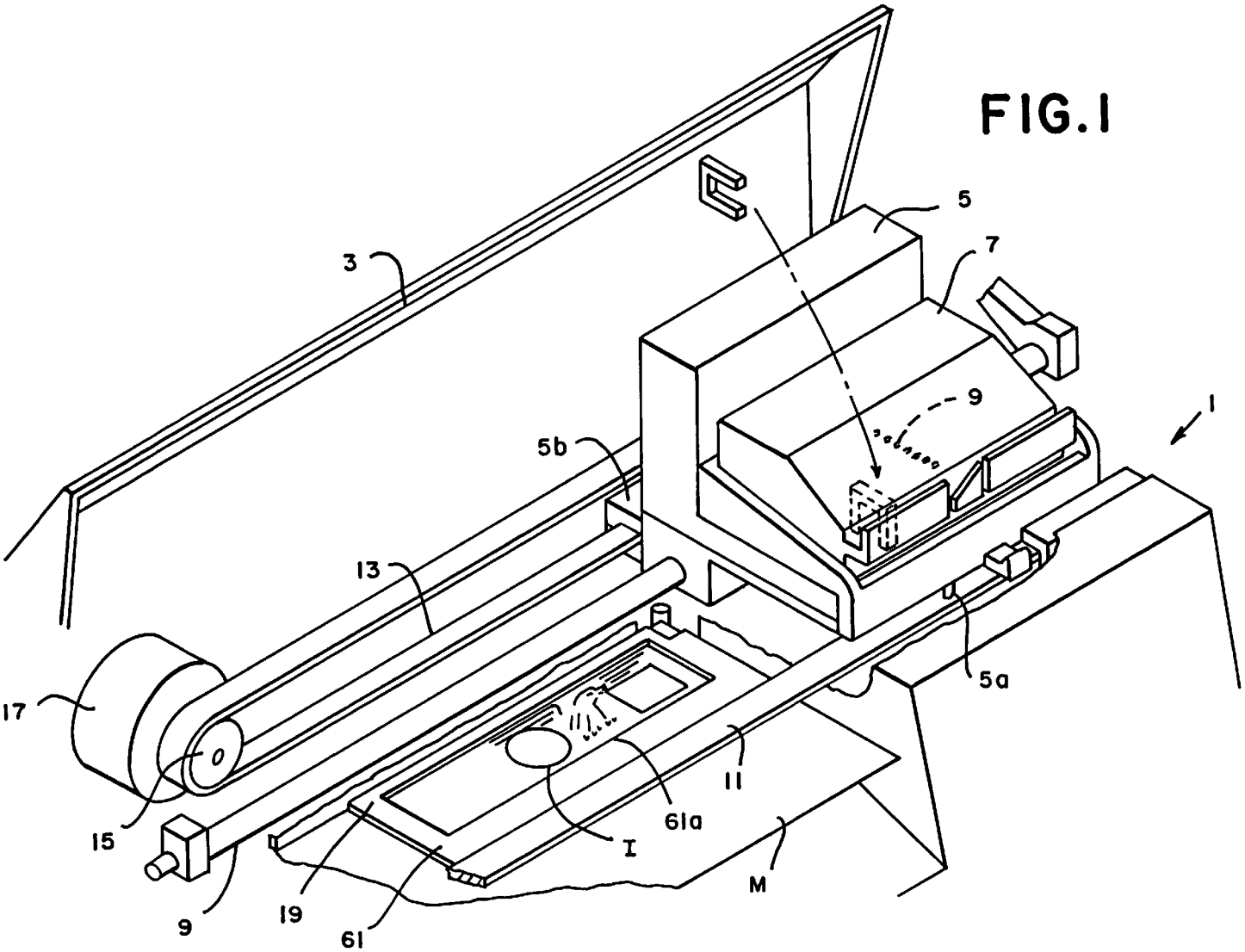
FIG. 1 shows a perspective, partially cut-away view, of a portion of a postage meter.

Referring to FIG. 1, there is shown a new low cost postage meter 1 having a cover 3 in the open position. On the outside of the cover 3 and not shown is a display as well as a keypad via which the operator receives instructions from and enters instructions into, respectively, postage meter 1 in order to effectuate printing of an indicia "I" on a mailpiece "M" which has been inserted into postage meter 1. Postage meter 1, as is known in the art, includes a carriage 5 upon which is mounted an ink cartridge 7 and a printhead, which for the purposes of simplicity, is only shown as a series of nozzles 9. The carriage 5 is mounted on a guide rod 9 to be slidable thereon and has a projection 5*a* at a front end thereof which rests on a fixed front horizontal surface 11 of postage meter 1 to stabilize carriage 5 in the position shown. Carriage 5 also has an extending portion 5*b* which is fixedly mounted to a continuous belt 13. A first end of belt 13 passes around a pulley 15 which is driven in either the clockwise or counterclockwise direction by bi-directional stepper motor 17. An opposite end of belt 13 passes around an idler pulley (not shown) such that changing the direction of movement of bi-directional motor 17 causes carriage 5 together with ink cartridge 7 and printhead 9 to move back and forth between a printing position above mailpiece "M" and a maintenance position as shown in FIG. 1. Mailpiece "M" is fixed in position relative to printhead nozzles 9 by being pressed up against a fixed upper plate 19 by a platen (not shown in FIG. 1) located beneath mailpiece "M".

Figure 2:
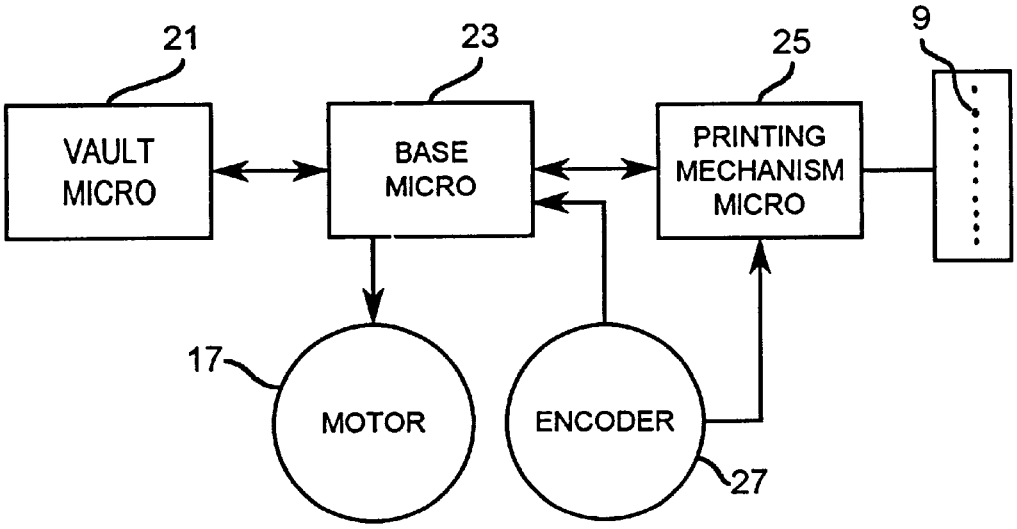
FIG. 2 shows a schematic representation of the control system for the postage meter.

While the synchronization of the moving of printhead nozzles 9 over a printing zone together with the energizing of each of nozzles 9 to expel ink therefrom is well known in the art, a brief schematic overview of the electronic architecture of postage meter 1 utilizing such principles is shown in FIG. 2. Postage meter 1 includes a vault microprocessor 21, a base microprocessor 23, and a printhead microprocessor 25. Vault microprocessor 21 performs funds accounting, while base microprocessor 23 manages the message interaction between the operator and postage meter 1. In addition, base microprocessor 23 acts as a communication channel between vault microprocessor 21 and printing microprocessor 25 to effectuate authorized indicia printing. Postage meter 1 also includes a conventional encoder 27 which provides a signal indicating the position of printing nozzles 9 at any point between its maintenance and printing positions. Encoder 27 provides a signal which is used by base microprocessor 23 to control operation of motor 17 and is also used by printhead microprocessor 25 to synchronize energizing of nozzles 9 relative to their movement.

Figure 3:
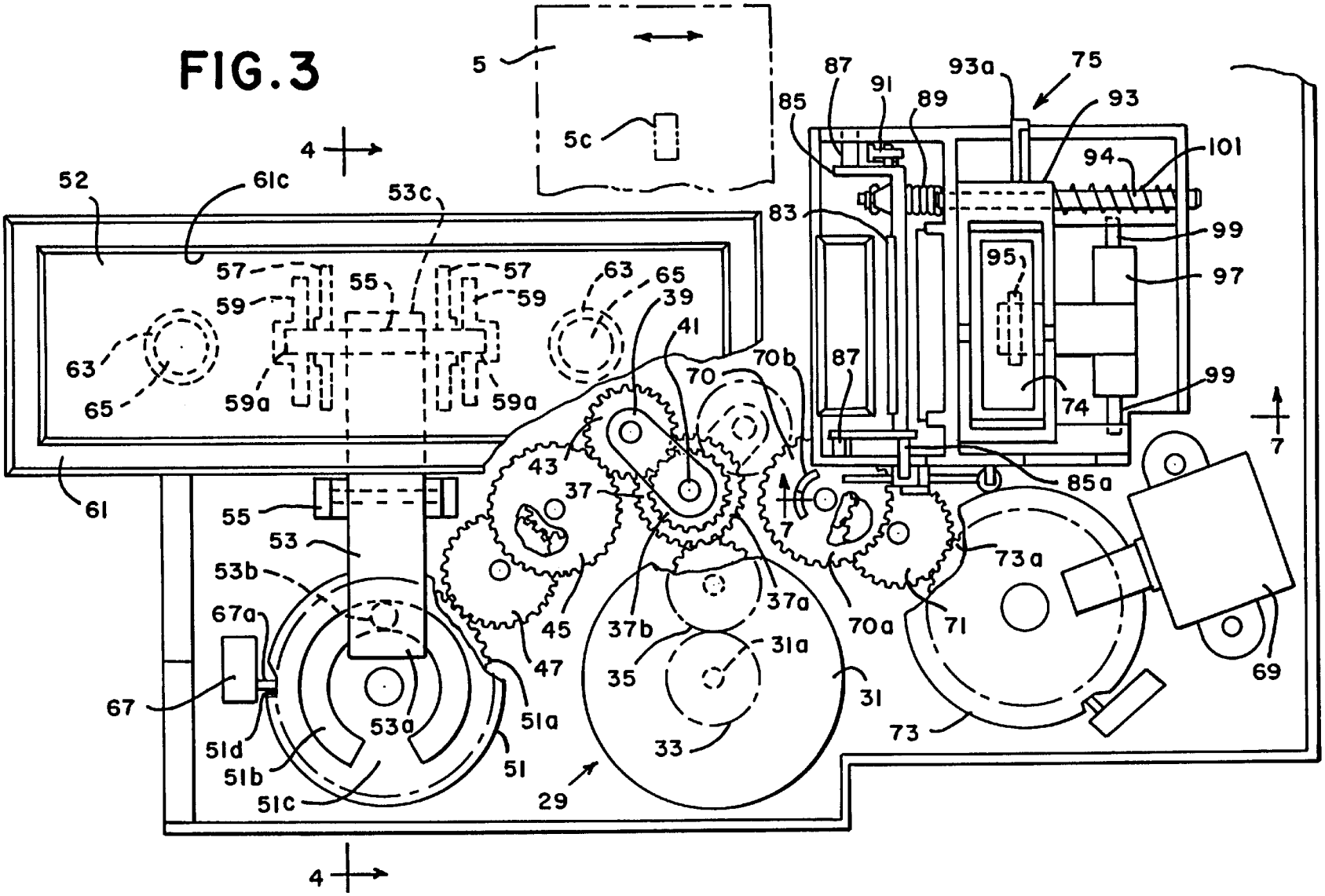
FIG. 3 shows a plan view of the postage meter as viewed along a horizontal plane below the printhead.

Referring to FIG. 3, the inventive drive train system 29 of postage meter 1 is shown. Drive train system 29 includes a motor 31 which is bi-directional. Motor 31 is a stepping motor and is pulsed via, for example, base microprocessor 23 in order to control the length of its operation and the direction of operation. The output shaft 31*a* of motor 31 is connected to a pinion gear 33 which in turn is intermeshed with an idler gear 35. Idler gear 35 is intermeshed with a gear 37 via a first set of gear teeth 37*a*. Gear 37 also has a second smaller set of gear teeth 37*b*. A swinging arm 39 is mounted for pivoting movement around gear 37 via a pivot joint 41. Pivot joint 41 has a small controlled amount of friction. Gears 43, 45 and 47 define a first gear train. Gear 43 intermeshes with gear teeth 37*b* as well as with gear 45 when swinging arm 39 is in the position shown in FIG. 1. Moreover, gear 45 is intermeshed with gear 47. Gear 47 in turn is intermeshed with a cam 51 via cam gear teeth 51*a*. Thus, as will be discussed in more detail below, cam 51 is driven into counterclockwise rotation by rotation of motor 31 in the counterclockwise direction in order to effectuate lifting of a platen 52 into engagement with mailpiece "M".

In operation, when motor 31 is driven in the counterclockwise direction, pinion gear 33 also rotates in the counterclockwise direction. This in turn causes idler gear 35 to rotate in the clockwise direction which in turn causes gear 37 to rotate in the counterclockwise direction. Rotation of gear 37 in turn causes rotation of gear 43 in the clockwise direction which causes rotation of gear 45 in the counterclockwise direction, rotation of gear 47 in the clockwise direction, and rotation of cam 51 in the counterclockwise direction. Thus, rotation of cam 51 is very accurately controlled by counting the number of pulses applied to stepping motor 31.

Figure 4:
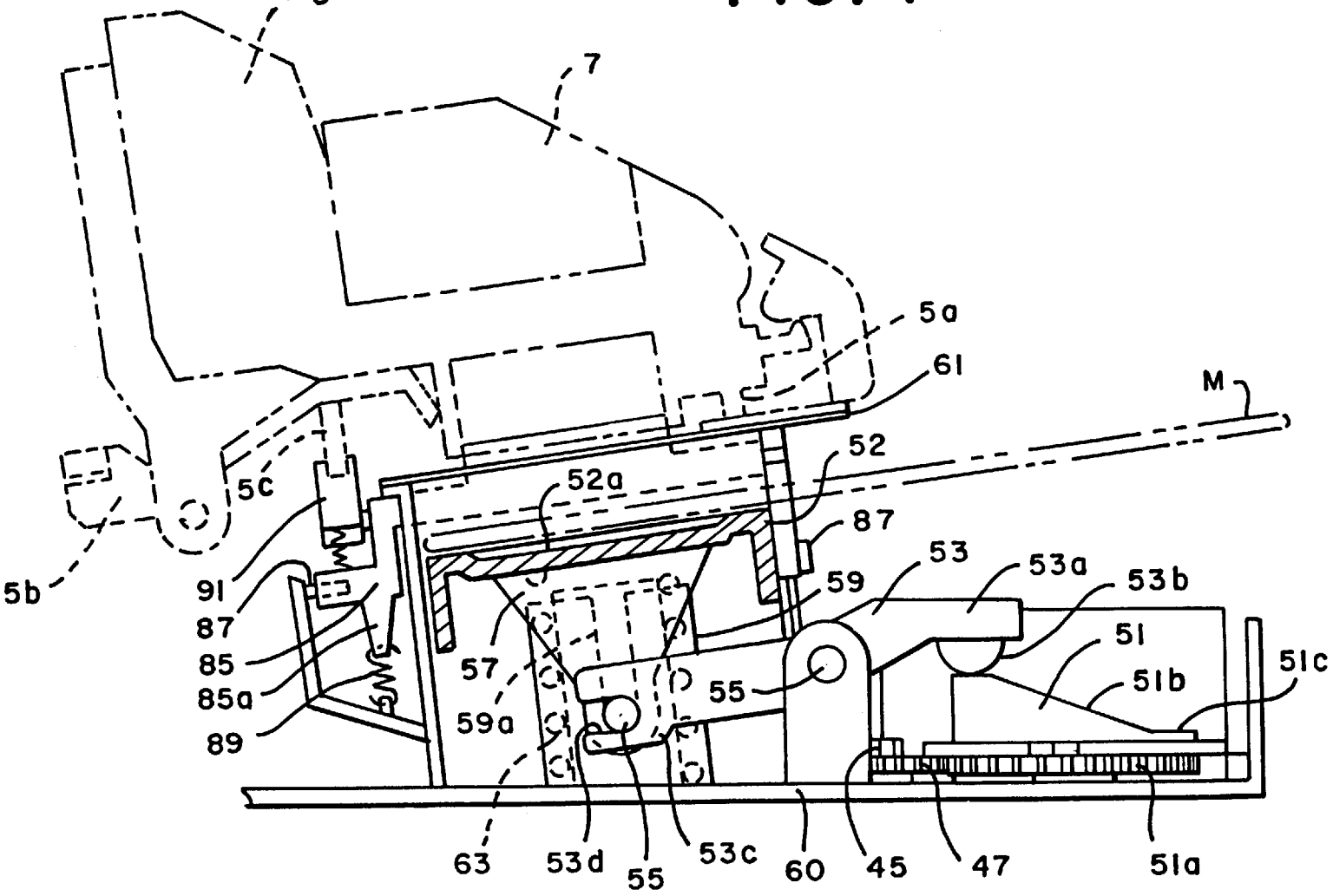
FIG. 4 is a view along line 4—4 of FIG. 3.

Cam 51 has a circular ramp 51*b* on its upper surface. A lever 53, which is pivotably mounted about a pivoting axis 55, has a first end 53*a* with a bearing surface projection 53*b* extending therefrom that rests on the highest point of circular ramp 51*b*, as shown in FIG. 4, when platen 52 is in its lowest position for receiving a mailpiece "M". An opposite end 53*c* of lever 53 has a slotted portion 53*d* therein which slidably retains a bar 55 which is fixedly connected to a pair of flanges 57 extending from the bottom of platen 52. Opposite ends of bar 55 extend into respective slots 59*a* of upstanding walls 59 which are fixedly attached to postage meter base 60. Thus, as lever 53 pivots about pivot axis 55 from the position shown in FIG. 4 platen 52 moves against mailpiece "M" until mailpiece "M" is fixed between platen 52 and a fixed upper registration deck 61. At this position, and 53*c* will be newly positioned above its position of FIG. 4.

Deck 61 has an opening 61*a* therein which is slightly larger than the indicia "I" to permit printing on mailpiece "M". A pair of springs 63 are disposed around respective posts 65 which are fixed to base 60. Springs 63 bias platen 52 in the upward direction. However, since end 53*a* of lever 53, in the position shown in FIG. 4, rests against circular ramp 51*b*, lever 53, via bar 55, retains platen 52 in its lowest position to receive mailpiece "M" against the biasing force of springs 63. However, as cam 51 is forced to rotate in the counterclockwise direction, as previously discussed, bearing surface 53*b* rides along circular ramp 51*b* toward a minimum ramp point 51*c*. Minimum ramp point 51*c* is opposite bearing surface 53*b* when cam 51 has been rotated 180 degrees. Bearing surface 53*b* follows ramp 51*b* because end 53*c* of lever 53 is forced upward by springs 63. The upward movement of lever end 53*c* causes bar 55 to slide within slot 53*d* and correspondingly causes platen 52 to move upward therewith. When cam 51 has been rotated 180 degrees, motor 31 is deenergized such that mailpiece "M" is firmly clamped in place between platen 52 and deck 61 and is and ready to be printed upon. Stepper motor 31 is controlled by base microprocessor 23.

The use of the structure described above allows for the clamping of various thickness mailpieces. That is, if a very thick mailpiece is inserted into the gap between the lowest position of platen 52 and deck 61 of the postage meter 1, and cam 51 is rotated in the counterclockwise direction, springs 63 force platen 52 to clamp the thick mailpiece at an earlier angular rotation of cam 51 as compared to a thinner mailpiece. When the clamping point has been reached and cam 51 continues to rotate, bearing surface 53*b* will no longer contact ramp surface 51*b*. On the other hand, if a minimum thickness envelope is inserted into postage meter 1 the angle of cam 51 rotation for which bearing surface 53*b* remains in contact with ramp surface 51*b* will be larger.

It is also important to note that since bar 55 is retained in lever slot 53*d*, platen 52 is free to swivel about 2 perpendicular axes so that the gripping force applied by platen 52 on mailpiece "M" is evenly distributed around opening 61*a* in deck 61. This action enables envelopes or mailpieces of uneven thickness to maintain contact around deck 61.

Platen 52 has a dished central area 52*a* so that the gripping forces on mailpiece "M" between platen 52 and deck 61 are concentrated around the perimeter of the area to be printed. Dished area 52*a* minimizes the potential pillowing effect that occurs when gripping a "fluffy" envelope. By keeping the top surface of the envelope flat and gripping the mailpiece "M" around the perimeter of opening 61*a* of deck 61, high quality printing is maintained.

In the preferred embodiment, stepping motor 31 is a 48 step/revolution motor, and drive train system 29 has a 30:1 gear reduction ratio. Thus, to rotate cam 51 180 degrees, the number of pulses required would be 48×30×180/360=720 pulses. Motor 31 is deenergized when the cam has been rotated 180 degrees to allow the printing operation to be performed. After printing, motor 31 is reenergized in its counterclockwise direction until an arm 67*a* of a microswitch 67 enters a recessed portion 51*d* of an outside surface of cam 51. The entry of arm 67*a* into recess 51*d* causes a signal to be sent to base microprocessor 23 indicating the return of platen 52 to its FIG. 4 position and the end of the platen clamping cycle. One skilled in the art will recognize that the above described clamping mechanism can be changed, for example, such that rotation of cam 51 for raising platen 52 can be reduced to 100 degrees with a corresponding rotation of 260 degrees for lowering platen 52. This would allow for a faster clamping operation and for stronger platen springs to be used.

The above description set forth how cam 51 operates to raise and lower platen 52 upon the rotation of motor 31 in the counterclockwise direction. Conversely, if motor 31 is rotated in the clockwise direction the inventive drive train system, rather than effectuating movement of platen 51, effectuates operation of priming pump 69. The key for accomplishing the driving of pump 69 occurs through the movement of swinging arm 39. That is, when motor 31 rotates in the clockwise direction a rotation of pinion gear 33, idler gear 35, and gear 37 will occur in an opposite direction as compared to their movement previously discussed. As smaller gear teeth 37*b* of gear 37 are forced into rotation in the clockwise direction, gear 43 will pivot together with swinging arm 39 in the clockwise direction from the solid line position of gear 43 to the broken line position of gear 43 until gear 43 crashes into and intermeshes with gear teeth gear 70*a* of gear 70. At this point in time gear 43 is intermeshed between gear teeth 37*b* and gear 70. As gear 43 rotates in a counterclockwise direction, it causes gear 70 to rotate in the clockwise direction. Gear 70 in turn is operatively connected to another gear 71 which is forced into rotation in the counterclockwise direction. Gear 71 is intermeshed with gear teeth 73*a* on a rotating two track cam structure 73 thereby forcing the rotating cam structure 73 to rotate in the clockwise direction.

Figure 5:
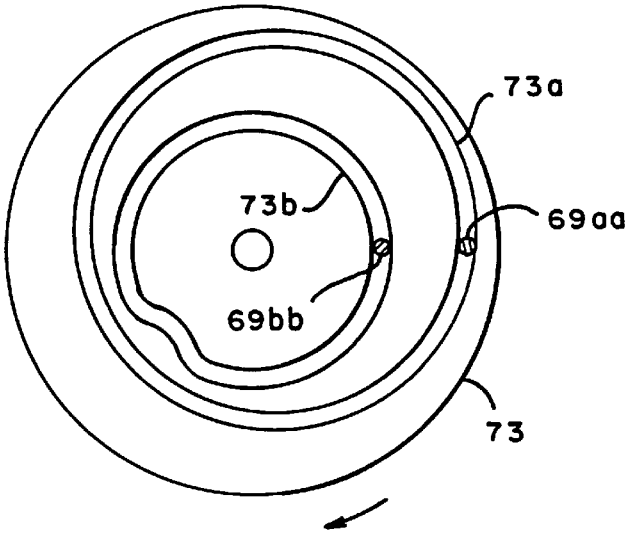
FIG. 5 is a top plan view of the cam surface.
Figure 6:
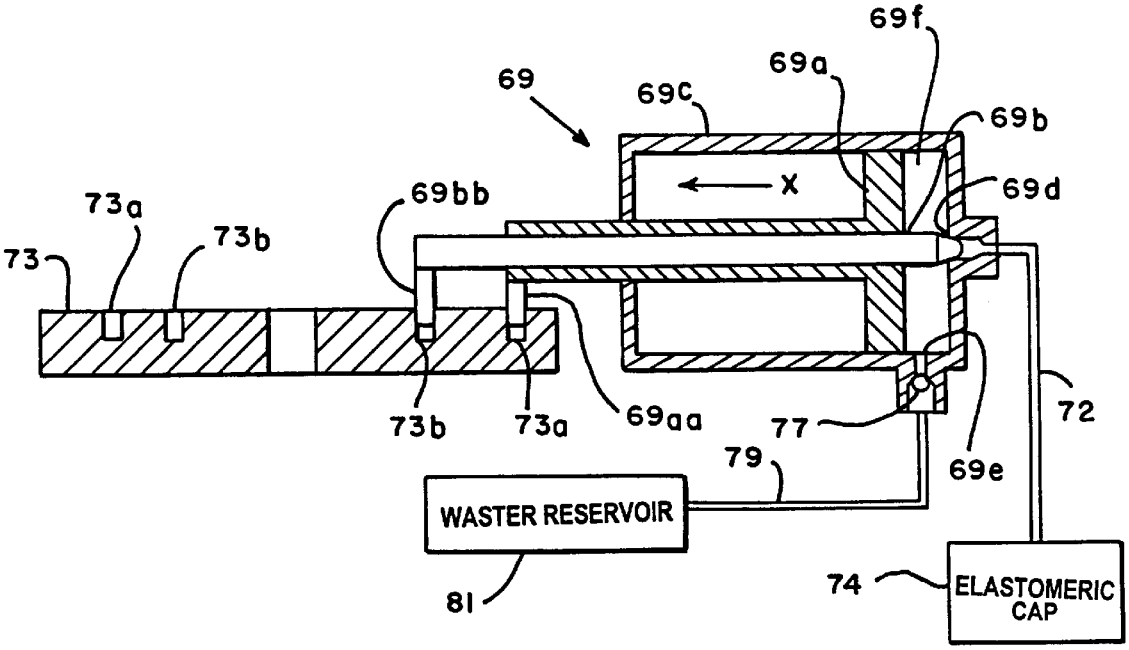
FIG. 6 is a schematic view of the priming pump.

Referring to FIGS. 5 and 6, cam 73 has two cam tracks 73*a* and 73*b* in a top surface thereof. Cam track 73*a* is used to regulate movement of a piston 69*a* of priming pump 69 while cam track 73*b* is used to regulate movement of a valve 69*b* of priming pump 69. Piston 69*a* is slidably mounted to a pump housing 69*c* which is fixedly connected to base 60 of postage meter 1. Valve 69*b* is slidably mounted within piston 69*a* and when situated in the position shown in FIGS. 5 and 6 seals an inlet opening 69*d* in housing 69*c*. Inlet opening 69*d* is connected via a tube 72 to an elastomeric cap 74 which is part of a maintenance station 75 shown in FIG. 3. Elastomeric cap 74 covers and hermetically seals printhead nozzles 9 when printhead nozzles 9 are in the maintenance position. Pump housing 69*c* also has an outlet opening 69*e* which has a one way check valve 77 therein. Check valve 77 will permit ink to flow from housing 69*c* via tubing 79 to a waste reservoir 81.

In operation, when priming pump 69 is positioned as shown in FIGS. 5 and 6, valve 69*b* seals inlet opening 69*d* such that ink cannot flow from elastomeric cap 74 into a chamber 69*f* defined between an outer surface of piston 69*a* and an inner surface of housing 69*c*. As dual track cam 73 is rotated in the clockwise direction, via the drive train 29 as discussed above, a first pin 69*aa* extending from piston 69*a* rides in piston track 73*a* forcing piston 69*a* to be withdrawn in housing 69*c* in the X direction. However, the profile of valve track 73*b* allows a second pin 69*bb* extending from valve 69*b* to remain in a stationary position such that valve 69*b* seals inlet 69*d* until cam 73 is rotated approximately 210 degrees. At 210 degrees of rotation, a detent portion 73*ba* of valve track 73*b* causes pin 69*bb* to move valve 69*b* in the "X" direction thereby opening inlet opening 69*d*. Since the rotation of cam 73 from the initial starting point up to 210 degrees created a vacuum in the expanding chamber 69*f*, when opening 69*d* is no longer sealed by valve 69*b*, ink will be sucked out of nozzles 9 through cap 74, tube 72 and into chamber 69*f* via inlet opening 69*d*. As cam 73 continues to rotate beyond 270 degrees such that pin 69*bb* will traverse the full detent portion 73*ba* of valve track 73*a*, valve 69*b* is returned to the position of FIG. 6 closing inlet opening 69*d*. As cam 73 continues to rotate a full 360 degrees, piston 69*a* is forced to move back toward opening 69*d* thereby forcing any ink which has been sucked into chamber 69*f* out of outlet opening 69*e*, through check valve 77, and into waste reservoir 81. An alternate embodiment of a priming pump and cam arrangement is disclosed in European Patent Application EP 0701061 A1.

Figure 7:
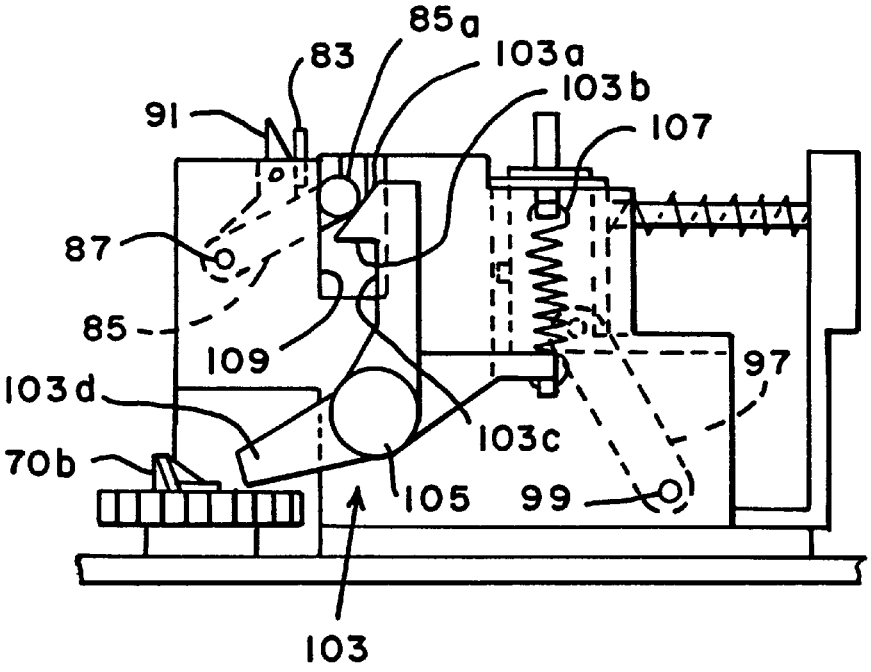
FIG. 7 is a view along line 7—7 of FIG. 3.

Referring now to FIGS. 3, 4 and 7, the operation of wiper blade 83 will be described. Wiper blade 83 is fixedly mounted on a bracket 85 which is pivotably mounted via pivot points 87 in postage meter 1. Thus, wiper blade 85 is movable between an operational position where it will wipe across nozzles 9 as the printhead 9 passes thereover, and an inoperative position which does not permit wiping of nozzles 9 as the printhead 9 passes thereover. Wiper blade 83 is normally biased into the operative position by a spring 89 connected at one end to a projection 85*a* of bracket 85 and at another end is operatively connected to postage meter base 60. Bracket 85 has a projection 91 connected thereto which is designed to interfere with a bottom projection 5*c* of carriage 5, as carriage 5 moves from the printing position into the maintenance position. As bottom projection 5*c* contacts projection 91, bracket 85 is pivoted in a clockwise direction (as viewed in FIG. 7) into the inoperative position of FIG. 7 such that printhead nozzles 9 pass thereover without being wiped. As carriage 5 moves further to the right in FIG. 3, projection 5*c* interferes with an arm 93*a* of a cap bracket 93 which is slidably mounted on a guide bar 94. Cap bracket 93 surrounds cap 74. Additionally, cap 74 is pivotably connected via a bar 95 to a lever 97 which is pivotably mounted via pivot points 99 to base 60. Accordingly, carriage 5 moves bracket 93 along with it thereby forcing lever 97 to rotate in a clockwise direction (as viewed in FIG. 7) such that cap 74 slides upwardly in bracket 93 to hermetically seal nozzles 9. When printhead 9 is moved to print on mailpiece "M", spring 101 returns bracket 93 to the position of FIG. 3.

A catch mechanism 103 is pivotably mounted via pivot point 105, to a frame portion of postage meter 1 immediately adjacent wiper bracket 85. A spring 107, which is connected at one end to the frame of postage meter 1 and at its other end to catch mechanism 103, biases catch mechanism 103 in the position shown in FIG. 7. As shown, when wiper 83 and wiper bracket 85 are biased in the wiper 83 operative position, a projection 85*a* of wiper blade bracket 85 is captured between an inclined surface 103*a* of catch mechanism 103 and a vertical wall 109 of maintenance station 75. Thus, projection 85*a* acts as a stop preventing further counterclockwise rotation (in FIG. 7) of catch mechanism 103 due to spring 107. Furthermore, as carriage 5 moves printhead 9 into the maintenance position and wiper bracket 85 is forced into rotation as discussed above, projection 85*a* is pushed down along inclined surface 103*a* forcing catch mechanism 103 to rotate in the clockwise direction against the force of spring 107 until projection 85*a* no longer contacts inclined surface 103*a*. When there is no longer contact between projection 85*a* and inclined surface 103*a*, the force of spring 107 causes catch mechanism 103 to rotate in the counterclockwise direction trapping projection 85*a* beneath a lip 103*b* of catch mechanism 103 and between vertical wall 109 and a vertical surface 103*c* of catch mechanism 103. In this position, wiper blade 83 is retained in the inoperative position and catch mechanism 103 is restricted from further counterclockwise movement. However, since nozzles 9 are to be wiped each time printhead 9 moves from the maintenance position to the printing position, a mechanism is required which causes wiper blade 83 to move from the inoperative position to the operative position to accomplish the wiping function. In the inventive apparatus, this occurs automatically when printhead 9 is primed via two track cam structure 73. That is, when drive train 29 is energized to operate priming pump 69, gear 70 is forced to rotate in the clockwise direction (as viewed in FIG. 3). Gear 70 has an inclined cam surface 77*b* thereon which interferes with a leg 103*d* of catch mechanism 103 during rotation of gear 70. As leg 103*d* of catch mechanism 103 rides up inclined cam surface 70*b*, catch mechanism 103 is forced to rotate in the clockwise direction (as viewed in FIG. 7) thereby freeing projection 85*a* from beneath lip 103*b* of catch mechanism 103. When projection 85*a* is free of lip 103*b*, wiper blade bracket 85 is forced by spring 89 to rotate into the operative position for subsequent wiping of nozzles 9.

The inventive drive chain system described above provides an extremely efficient and cost effective structure for performing a plurality of important functions in a postage meter. Additional advantages and modifications of the above described structure will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims or their equivalents.

What is claimed is:

1. A postage meter comprising:

means for printing a dot-matrix postal indicia on a mailpiece; and a drive train system including a moveable platen for positioning the mailpiece in fixed relationship to the means for printing, means for priming the printing device, a gear train, and a motor; wherein said gear train comprises a plurality of gears including at least one swinging gear which is mounted to swing between a first swinging gear position and a second swinging gear position such that when said swinging gear is in said first swinging gear position said motor causes said gear train to drive said platen into movement and when said swinging gear is in said second swinging gear position said motor causes said gear train to drive said priming means to prime said means for printing.

2. A postage meter as recited in claim 1, further comprising a wiper blade moveable between an operative position for wiping the means for printing and an inoperative position where no wiping occurs, said motor driving said gear train into operative engagement with said wiper blade for effectuating movement of said wiper blade between said inoperative and operative positions.

3. A postage meter as recited in claim 1, wherein said motor is operable in first and second directions and said motor when operating in said first direction causes said swinging gear to move to said first swinging gear position to drive said platen into movement, and said motor when operating in said second direction causes said swinging gear to move to said second swinging gear position to drive said priming means to prime said means for printing.

4. A postage meter as recited in claim 3, further comprising a cam mounted for rotation and having a circular ramp thereon, a lever mounted to pivot and having a first end positioned to ride on said circular ramp and a second end mounted on said platen, wherein at times when said swinging gear is moved to said first swinging gear position by said motor said swinging gear drives said cam into rotation causing said first end of said lever to ride along said circular ramp thereby pivoting said lever to alternately raise and lower said second end of said lever and said platen.

5. A postage meter as recited in claim 4, wherein said platen is mounted to said second end of said lever such that said platen is pivotable about two axes.

6. A postage meter as recited in claim 5, wherein said platen has a central dished portion.

7. A postage meter as recited in claim 6, wherein said printing means is an inkjet printer.

8. A postage meter as recited in claim 3, further comprising a cam mounted for rotation and being in operative engagement with said priming means and said swinging gear such that at times when said swinging gear is in the second swinging gear position said swinging gear drives said cam into rotation causing said cam to effectuate a priming operation by said priming means.

9. A postage meter as recited in claim 8, wherein said cam has first and second cam tracks therein, and said priming means includes a piston and a valve connected to respectively follow in said first and second cam tracks, wherein during rotation of said cam movement of said piston and valve relative to each other for controlling operation of said priming means occurs as said piston and valve respectively follow said first and second cam tracks.

10. A postage meter as recited in claim 9, further comprising a wiper blade moveable between an operative position for wiping the means for printing and an inoperative position where no wiping occurs, said motor driving said gear train into operative engagement with said wiper blade for effectuating movement of said wiper blade between said inoperative and operative positions.

11. A postage meter as recited in claim 10, further comprising a triggering device and wherein at times when said swinging gear is in said second swinging gear position to effectuate said priming operation by said priming means said gear train moves said triggering device to permit said wiper blade to move between said inoperative and operative positions.

* * * * *